United States Patent [19]

Palm

[11] 4,083,546

[45] Apr. 11, 1978

[54] RUG HOLDER

[75] Inventor: Leonard R. Palm, Everett, Wash.

[73] Assignee: The Raymond Lee Organization, Inc., New York, N.Y. ; a part interest

[21] Appl. No.: 812,238

[22] Filed: Jul. 1, 1977

[51] Int. Cl.[2] ..... B25B 1/20

[52] U.S. Cl. ..... 269/152; 269/228; 269/309; 269/321 W

[58] Field of Search ..... 269/74, 104, 152, 289 R, 269/309, 321 W, 228

[56] References Cited

U.S. PATENT DOCUMENTS

| | | | |
|---|---|---|---|
| 288,035 | 11/1883 | Dixon | 269/104 |
| 1,281,680 | 10/1918 | Smith | 269/309 |
| 1,466,746 | 9/1923 | Ohlen | 269/152 |

*Primary Examiner*—Robert C. Watson
*Attorney, Agent, or Firm*—Daniel Jay Tick

[57] ABSTRACT

A support arm is adjustable in length and is affixed to the center of a bottom cross arm to form a T-shaped structure. A pair of clamping devices are affixed to the opposite ends of the bottom cross arm and to the opposite ends of a top cross arm of the same length. The clamping devices in closed position support the cross arms in next-adjacent relation to clamp a rug between them with the rug resting on the support arm. In open position, the clamping devices support the cross arms in spaced parallel relation to position the rug therebetween. A plurality of mounting members are affixed to the bottom cross arm and the support arm.

2 Claims, 4 Drawing Figures

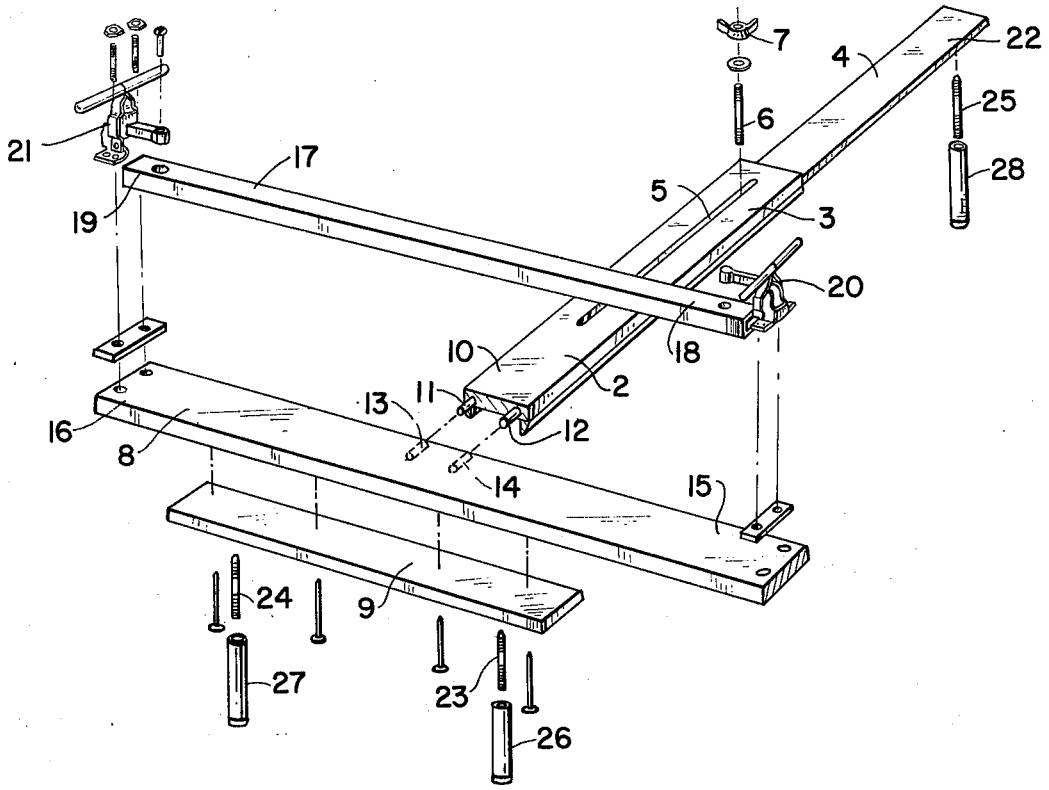
FIG. 1
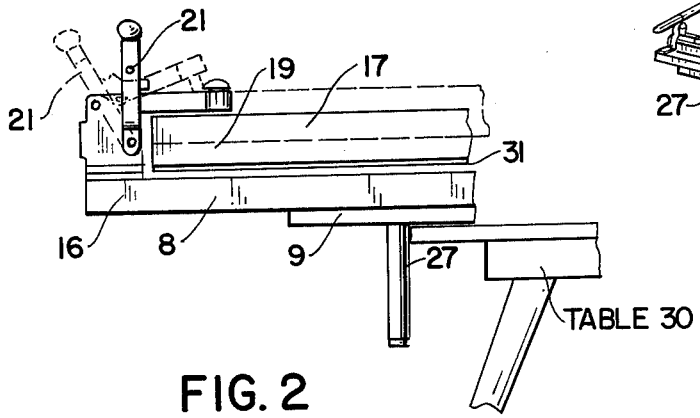
FIG. 2
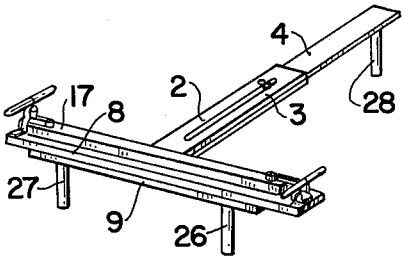
FIG. 4
FIG. 3
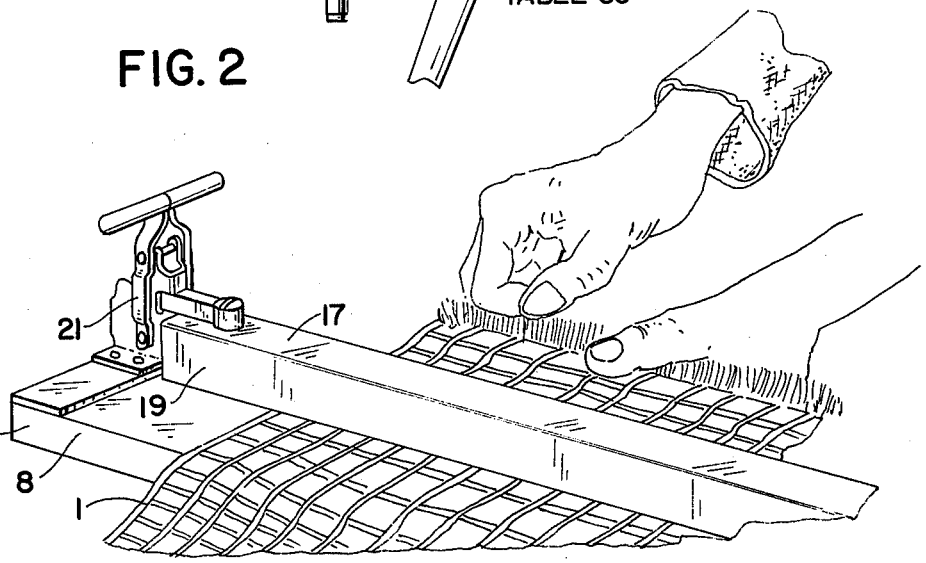

RUG HOLDER

BACKGROUND OF THE INVENTION

The present invention relates to a rug holder. More particularly, the invention relates to a rug holder for supporting a rug during home manufacture thereof.

Objects of the invention are to provide a rug holder of simple structure, which is inexpensive in manufacture, used with facility and convenience, and functions efficiently, effectively and reliably to support a rug during a home manufacturing process thereof.

BRIEF DESCRIPTION OF THE DRAWINGS

In order that the invention may be readily carried into effect, it will now be described with reference to the accompanying drawings, wherein:

FIG. 1 is an exploded perspective view of an embodiment of the rug holder of the invention;

FIG. 2 is a view, on an enlarged scale, of part of the embodiment of FIG. 1, in assembled condition;

FIG. 3 is a perspective view, on an enlarged scale, of part of the embodiment of FIG. 1, in use; and FIG. 4 is a perspective view, on a reduced scale, of the embodiment of FIG. 1 in assembled condition.

DETAILED DESCRIPTION OF THE INVENTION

The rug holder of the invention supports a rug 1 during home manufacture, as shown in FIG. 3.

The rug holder of the invention comprises a support arm 2 having two components 3 and 4 releasably affixed to each other, as shown in FIG. 1, whereby said support arm is adjustable in length. Thus, for example, as shown in FIG. 1, the component 3 has a slot 5 formed therethrough extending along the length thereof at the center thereof. The component 4 has a bore formed therethrough (not shown in the FIGS.). A pin type device 6 is provided and is affixed to the component 4 and through the slot 5 of the component 3 and is tightened in position by a wing nut 7 which is threadedly coupled at one end thereof. Thus, the components 3 and 4 are positioned to provide a desired overall length and the wing nut 7 is then tightened at such desired length.

A bottom cross arm 8, reinforced by an ancillary bottom cross arm 9 in juxtaposition with part thereof (FIGS. 1 and 2), is affixed at its center to one end 10 of the support arm 2 to form a T-shaped structure, as shown in FIG. 1. The support arm 2 and the bottom cross arm 8 are affixed to each other by any suitable device such as, for example, a pair of pegs 11 and 12 extending from the end 10 of the component 3 of the support arm 2 and a pair of peg holes 13 and 14 for accommodating said pegs in a secure fashion. The bottom cross arm 8 is of predetermined length and has spaced opposite first and second ends 15 and 16, respectively (FIG. 1).

A top cross arm 17, 2½ inches shorter than the bottom cross arm 8, has spaced opposite first and second ends 18 and 19, respectively, (FIG. 1).

Clamping devices 20 and 21 are affixed to the first and second ends 15 and 16, respectively, of the bottom cross arm 8 and the first and second ends 18 and 19, respectively, of the top cross arm 17 (FIG. 1). The clamping devices 20 and 21 are of any suitable known type which, in closed position, shown by solid lines in FIGS. 2 and 3, support the cross arms 8 and 17 in next-adjacent relation to clamp the rug 1 between them. The rug 1 then rests on the support arm 2. The clamping devices 20 and 21 also function in a known manner, when in open position, shown by broken lines in FIG. 2, to support the cross arms 8 and 17 in spaced parallel relation whereby there is a gap provided between said cross arms so that the rug 1 is readily positioned between said cross arms in the gap therebetween. The user thus manually operates the clamping devices 20 and 21 to first open them and position the rug 1 between the cross arms 8 and 17, as desired, and then closes the clamping devices to secure the rug in position.

A plurality of mounting members are affixed to, and extend substantially perpendicularly from, the bottom cross arm 8 in the areas of the ends 15 and 16 thereof and the support arm 2 in the area of the free end 22 thereof (FIG. 1). The mounting members hang over a supporting table at opposite edges thereof, so that the T-shaped structure is held on the supporting table at the opposite edges. Thus, a pair of pins 23 and 24 are externally threaded at both ends and are embedded at one end in the bottom cross member 8 in the areas of the first and second ends 15 and 16, respectively, thereof and a pin type member 25, externally threaded at both ends is embedded at one end in the support arm 2 in the free end 22 thereof, as shown in FIG. 1. Tubular components 26, 27 and 28 comprise rubber tubing and are threadedly coupled to the pin type members 23, 24 and 25, respectively, at the ends thereof opposite those embedded in the structure.

The mounting members 26, 27 and 28 are covered with rubber to prevent scratching of the edges of a supporting table 29 (FIG. 2).

The top cross arm 17 has a rubber pad 31 on its lower surface, as shown in FIG. 2.

While the invention has been described by means of a specific example and in a specific embodiment, I do not wish to be limited thereto, for obvious modifications will occur to those skilled in the art without departing from the spirit and scope of the invention.

I claim:

1. A rug holder for supporting a rug during home manufacture thereof, said rug holder comprising a support arm having two components releasably affixed to each other whereby said support arm is adjustable in length;

a bottom cross arm affixed at its center to one end of the support arm and extending perpendicularly to said support arm to form a T-shaped structure, said bottom cross arm being of predetermined length and having spaced opposite first and second ends;

a top cross arm of the predetermined length having spaced opposite first and second ends;

a pair of clamping devices affixed to the first and second ends of the bottom cross arm and cooperating with the top cross arm, said clamping devices in closed position supporting said cross arms in adjacent parallel relation to clamp a rug between them, said rug resting on the support arm, and said clamping devices in open position supporting said cross arms in spaced parallel relation to permit the positioning of said rug therebetween; and a plurality of mounting members affixed to, and extending substantially perpendicularly from, the bottom cross arm in the areas of the ends thereof and the support arm in the area of the free end thereof, said mounting members hanging over a supporting table at opposite edges thereof to hold the T-shaped structure on the table at said opposite edges.

2. A rug holder as claimed in claim 1, further comprising rubber covers on the mounting members to hold the T-shaped structure on a supporting table at the opposite edges thereof.

* * * * *